US007651390B1

(12) United States Patent
Profeta et al.

(10) Patent No.: US 7,651,390 B1
(45) Date of Patent: Jan. 26, 2010

(54) CEILING VENT AIR DIVERTER

(76) Inventors: Jeffery L. Profeta, 13728 Weeping Willow Ct., Corona, CA (US) 92880; Mario S. Peca, 626 Darrell St., Costa Mesa, CA (US) 92627; Gregory Glodery, 9602 Indian Wells Cir., Huntington Beach, CA (US) 92646

( * ) Notice: Subject to any disclaimer, the term of this patent is extended or adjusted under 35 U.S.C. 154(b) by 0 days.

(21) Appl. No.: 12/218,264

(22) Filed: Jul. 14, 2008

Related U.S. Application Data

(63) Continuation-in-part of application No. 11/684,858, filed on Mar. 12, 2007, now abandoned.

(51) Int. Cl.
*F24F 13/06* (2006.01)
*F24F 13/08* (2006.01)
*F24F 13/00* (2006.01)

(52) U.S. Cl. ..... 454/307; 454/284; 454/292; 454/306; D23/387; D23/388

(58) Field of Classification Search ..... 454/292, 454/296, 302, 307, 358, 284, 306; D23/365, D23/387, 388
See application file for complete search history.

(56) References Cited

U.S. PATENT DOCUMENTS 450,322 A * 4/1891 Segal ..... 55/505
562,530 A * 6/1896 Hanson ..... 454/289
674,991 A * 5/1901 Williams ..... 454/289
D49,102 S * 5/1916 Triggs ..... D23/388
2,080,726 A * 5/1937 Lowinger ..... 55/511
D104,763 S * 6/1937 Black ..... D23/388
3,301,164 A * 1/1967 Eberhart ..... 454/319
D225,010 S * 10/1972 Steiner ..... D23/411
D225,011 S * 10/1972 Steiner ..... D23/411
4,182,227 A * 1/1980 Roy ..... 454/302
D271,900 S * 12/1983 Efstratis ..... D23/387
D275,988 S * 10/1984 Walker ..... D23/392
4,502,368 A * 3/1985 Hempel ..... 454/277
4,520,715 A * 6/1985 Coomes et al. ..... 454/367
D281,999 S * 12/1985 Shames et al. ..... D23/391

(Continued)

FOREIGN PATENT DOCUMENTS

DE 3139997 A1 * 3/1983

*Primary Examiner*—Steven B McAllister
*Assistant Examiner*—Patrick F. O'Reilly, III
(74) *Attorney, Agent, or Firm*—Gordon K. Anderson

(57) ABSTRACT

A ceiling vent air diverter is taught, in the preferred embodiment, which incorporates a diverter body configured to cover beneath an existing air vent supplying air to a room of a building. The diverter body has a rectangular flat bottom and upstanding sides with each upstanding side having a discharge air slot permitting air to be distributed in opposed directions from the diverter at a ceiling level. A peripheral flange extends outwardly from each side of the body, in parallel relationship with the bottom and is used for attachment to the building ceiling. A second embodiment is configured and functions in the same manner as above but covers over the top of an existing air vent and includes a lip on the underside of the flange. The third embodiment is for a ceiling air duct diverter system consisting of a box like housing with side walls, an open top and open sides to divert air flow and having the capability of affixing the open top near a ceiling air vent.

15 Claims, 5 Drawing Sheets

U.S. PATENT DOCUMENTS

| | | | | |
|---|---|---|---|---|
| 4,693,174 | A * | 9/1987 | Anderson | 454/292 |
| 5,292,282 | A * | 3/1994 | Callas | 454/292 |
| D382,049 | S * | 8/1997 | Trampp | D23/365 |
| 5,807,171 | A * | 9/1998 | Felsen | 454/296 |
| 6,302,784 | B1 | 10/2001 | Berger | |
| 6,422,935 | B1 | 7/2002 | Yampolski | |
| 6,544,115 | B1 | 4/2003 | Graf | |
| 6,554,880 | B1 | 4/2003 | Northcutt | |
| 6,592,237 | B1 * | 7/2003 | Pledger | 362/147 |
| 6,745,518 | B2 * | 6/2004 | Weakes et al. | 52/22 |
| 6,786,817 | B2 | 9/2004 | Orendorff | |
| 6,832,951 | B2 | 12/2004 | Orendorff | |
| 6,848,990 | B2 | 2/2005 | Berger | |
| 6,866,578 | B2 | 3/2005 | Orendorff | |
| 2001/0023173 | A1 | 9/2001 | Schiedegger et al. | |
| 2001/0046838 | A1 | 11/2001 | Hertel | |
| 2002/0022450 | A1 | 2/2002 | Berger | |
| 2002/0069599 | A1 | 6/2002 | Dhallan | |
| 2003/0220069 | A1 | 11/2003 | Oerndorff | |
| 2006/0025067 | A1 | 2/2006 | Koessler | |

* cited by examiner 10
20
32
28
24
22
30

10
20
28
30
22
32
24

20
24
22
8
8
26
32

10
26
32
20
22
30
28
24

22
24
20
10
32
30
28

22
24
32
42

40

44
32
34
24
22

34
46

36

38

CEILING VENT AIR DIVERTER

CROSS REFERENCE TO RELATED APPLICATION

This application is a continuation-in-part of application Ser. No. 11/684,858 filed Mar. 12, 2007 now abandoned.

FIELD OF THE INVENTION

The present invention is directed toward an air vent diverter which is placed over an existing vent to prevent air from flowing downward and to direct the air across the ceiling to enhance air flow.

BACKGROUND OF THE INVENTION

Frequently it is often desirable to divert an air duct in a direction other than that provided by the duct or register. Often the existing duct work may divert the air conditioning/heating in a non-optimized way, such as in a downward direction. This flow direction may introduce cold or hot air toward people causing irritating discomfort particularly in bedrooms where the air may impinge onto sleeping persons.

There have been a number of patents directed to the field of vent covers. U.S. Patent Application Publication No. 20060025067 to Koessler discloses a vent comprising a cover member having a cover member surface which defines at least a portion of a vent passageway. The cover member has at least one first connector and at least one second connector spaced outwardly from the first connector. The first and second connectors are operable to provide pivotal coupling to a damper.

U.S. Patent Application Publication No. 20030220069 to Oerndorff discloses a wooden vent cover that has fixed vanes with major vane surfaces at right angles which enhance the throw and spread of air flow through the vent cover. It is a vent assembly with a wooden vent cover having optimized vane major surface angles including an air flow regulator in combination with the wooden vent cover. The air flow regulator may be a slideable member or another configuration and may be held in place by couplers.

U.S. Patent Application Publication No. 20020069599 to Dhallan discloses a vent cover plate system for the register of a ventilation system that securely fits over the register thereby blocking the flow of air from that register. The vent cover plate is attached with hook and loop fastening material or magnetic material.

U.S. Patent Application Publication No. 20020022450 to Berger discloses a modular air vent assembly kit use to cover duct openings and consists of a frame, base, damper mechanism and two different face plates.

U.S. Patent Application Publication No. 20010046838 to Hertel discloses a counterweight biased duct vent closure and door for a conventional overhead or surface mounted air supply vent opening. The closure door includes a covering sized to fit over the register when not in use while automatically opening when operating using a counterweight.

U.S. Patent Application Publication No. 20010023173 to Schiedegger et al. discloses a vent for cooperating with duct work associated with an exhaust fan. A base member and cover with a screen are released from the base member.

U.S. Pat. No. 6,866,578 to Orendorff discloses disclose a wooden vent cover that has fixed vanes with major vane surfaces at right angles which enhance the throw and spread of air flow through the vent cover. It is a vent assembly with a wooden vent cover having optimized vane major surface angles including an air flow regulator in combination with the wooden vent cover. The air flow regulator may be a slideable member or another configuration and may be held in place by couplers.

U.S. Pat. No. 6,422,935 to Yampolski discloses a provided air vent covering which is adapted to be mounted to a floor, in the peripheral region of an air vent opening therethrough. The air vent covering assembly comprises a cover plate, a base, at least one damper plate, and first and second brackets. The cover plate and base have a plurality of spaced-apart and substantially parallel louvers formed therein, and each of the plurality of louvers defines an edge of a space. Each of the at least one damper plate includes a plurality of spaced-apart and substantially parallel damper bars, and the number of damper bars is equal to the number of louvers provided. When the damper plate is in an open position, flow of air thorough the spaces defined by the plurality of louvers is allowed, and when the damper plate is in a closed position, flow of air though the spaces is precluded.

U.S. Pat. No. 6,832,951 to Orendorff discloses a vent assembly including a vent cover and sliding air flow regulator connected by unique couplers. A vent assembly for corner applications is also disclosed.

U.S. Pat. No. 6,786,817 to Orendorff discloses a vent assembly including a vent cover and sliding air flow regulator for controlling air through the vent cover. A set of couplers interconnect the regulator and cover in a sliding motion.

U.S. Pat. No. 6,848,990 issued to Berger discloses a register assembly for covering an air duct opening that is comprised of a faceplate, a base, a damper and a filter frame made of plastic snapped together without tools.

U.S. Pat. No. 6,544,115 to Graf discloses a fairing vent comprising a louver rotatably attached to a body, and a louver handle attached to the louver, and a method of installing the fairing vent on a vehicle fairing. The body contains a duct having a duct intake and a duct outlet. The louver is sized to block airflow through the duct when the fairing vent is in the closed position. The fairing vent is closed by rotating the louver using the louver handle until the louver blocks airflow through the duct. A lip is disposed around the duct intake. At least one resilient tab is disposed on the body, each resilient tab being biased away from the body at an angle of approximately 10 degrees. Each resilient tab is disposed a sufficient distance from the lip so as to sandwich the thickness of a vehicle fairing between the lip and the resilient tab(s). The fairing vent is installed on the fairing by cutting a fairing cutout into the fairing. The fairing cutout is sized to admit the body but not the lip. The body is then pushed into the fairing cutout, forcing the resilient tab(s) against, or flush with, the body against each resilient tab(s) installed bias away from the body, until the lip buts up against the fairing. At this point the resilient tab(s) spring back into their installed biased position away from the body, thus Tramping the fairing between the resilient tab(s) and the lip, thus immobilizing the fairing vent relative to the fairing.

U.S. Pat. No. 6,302,784 to Berger discloses a modular air vent assembly kit used to cover a duct opening supplying air to a room, comprised of a base, a damper and two faceplates. One faceplate has a lattice and the other louvers.

U.S. Pat. No. 6,554,880 issued to Northcutt teaches an apparatus for a discharge vent on an air circulation system which includes structures for controlling the direction and quantity of airflow. Filter elements may be provided to help reduce contaminants that might otherwise be discharged through the vent. Preferred methods for assembling and using the apparatus are disclosed.

While there have been systems for various air filters used in homes, there has heretofore been no retrofitable system for diverting a ceiling air duct. In particular, there has been no easy way to alter the flow of air in a downward air duct.

OBJECTS AND SUMMARY OF THE INVENTION

As stated previously a problem has existed for some time that many people find direct air impingement from an air conditioning system to be unpleasant as the air movement or draft is irritating causing the temperature to feel to the person either much colder or hotter than the surrounding environment. Most air distribution diffusers, registers and grilles are designed to either guide the flow of air with directional vanes, louvers, dampers or combinations thereof to achieve laminar counter flow while having a predetermined length of blow. While much time and effort has been applied in the past to optimize the comfort level of the occupants of a building it is impossible to please everyone all of the time. To solve this long felt problem, after the original new building installation, the present invention may be fitted directly over the existing air vent and simply divert the air in an appropriate direction.

A primary object of the invention is therefore to provide a retrofittable device that may be easily mounted, diverting the air flow from the existing air duct equipment directly along the ceiling or wall away from the occupants without disturbing the original design function of the system. In most instances the airflow through existing building ductwork is sized to produce a balance of air in each room relative to its size and distance from the air temperature control source. The diffusers, registers and grilles are specifically selected in size and pressure differential to obtain this system balance therefore the invention is configured to provide a minimal pressure drop when mounted and linearly directs the air flow as four directionally opposed openings are provided to achieve this functional operation.

An important object of the invention is that the air is directed to flow over the ceiling or wall and disperse throughout the room with a velocity sufficient enough to circulate the air properly yet achieve the result without an annoying draft.

Another object of the invention is that the invention may be made in a variety of sizes that easily fit over any rectangular diffuser, register or grille and with straightforward modifications in size. Even round devices may be accommodated without changing the diverter basic design.

Still another object of the invention is that the inside surface of the diverter is smooth without obstructions and radiuses on edges and corners, allowing air to penetrate the room and cover large areas and have pressure resistance minimums such as maintaining 30% unrestricted air flow required by many building codes and design specifications. The diffuser saves energy as a constant room temperature creates a comfortable temperature without downdrafts or cold spots and dampens thermostat cycling.

Yet another object of the invention is realized as there are three individual embodiments with the preferred embodiment ideally suited for T-bar suspended ceilings. The second embodiment includes an additional peripheral lip allowing the diffuser to easily fit over a raised frame type vent or register on a ceiling or wall. A third embodiment is for a box like housing with side walls and an open top with openings on the side walls to divert air flow and means utilizing fabric hook and loop fasteners, magnets or screws for affixing the open top over a ceiling air vent and duct so that the air is diverted though the side openings.

A further object of the invention provides the incorporation of light weight thermoplastic materials which meet UL94JB fire rating and presents no health hazard along with a textured finish which blends in well with existing ceilings or walls and may be painted to match the décor of the room.

Yet another object is directed to the various sizes that may be made to accommodate the different shapes of the existing air grilles, registers and diffusers. In most cases a rectangular shape is called for with square the most popular with ceiling mounts and oblong shapes for wall mounts. Normal sizes vary in the square configuration from 24 inches to as small as 8 inches with oblong common sizes are 16×18 to 8×10 however any physical size may fall within the scope of the invention.

Another object of the invention is that the diffuser in the preferred embodiment may be mounted by a myriad of mounting methods including metal binder clips, fabric hook and loop fasteners, 3M Dual Lock® tape, magnetic tapes and threaded fasteners for the preferred embodiment. Sheet metal screws, self tapping screws, wood screws, toggle bolts, masonry anchors, hollow wall screw anchors and self drilling wall board anchors may be utilized for the second embodiment.

In a third embodiment, the present invention discloses a ceiling air duct diverter system comprising a plurality of side openings on a housing with side walls having an open top and an open side, and a means to divert the air flow though the side openings.

A final object is the ease of manufacture using the vacuum forming procedure which is well know in the art and the tooling is relatively inexpensive permitting the finished product to be economical. Further the discharge air slots in the sides are cut after the molding process is completed permitting omission of some slots in specific sides in special factory orders.

These and other objects and advantages of the present invention will become apparent from the subsequent detailed description of the preferred embodiment and the appended claims taken in conjunction with the accompanying drawings.

DETAILED DESCRIPTION OF THE INVENTION

Figure 1:
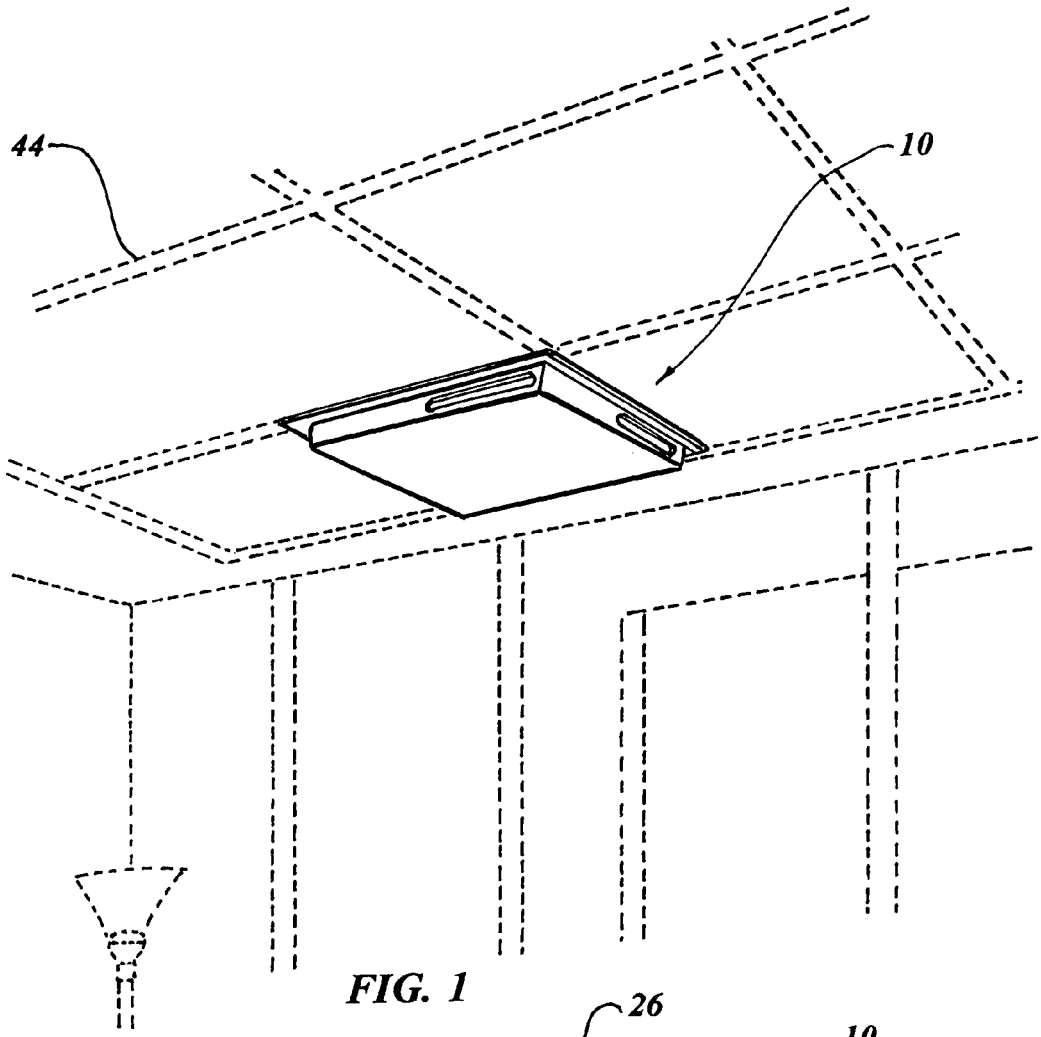
FIG. 1 is a partial isometric view of the ceiling air duct diverter installed in a T-bar supported ceiling utilizing the preferred embodiment.
Figure 2:
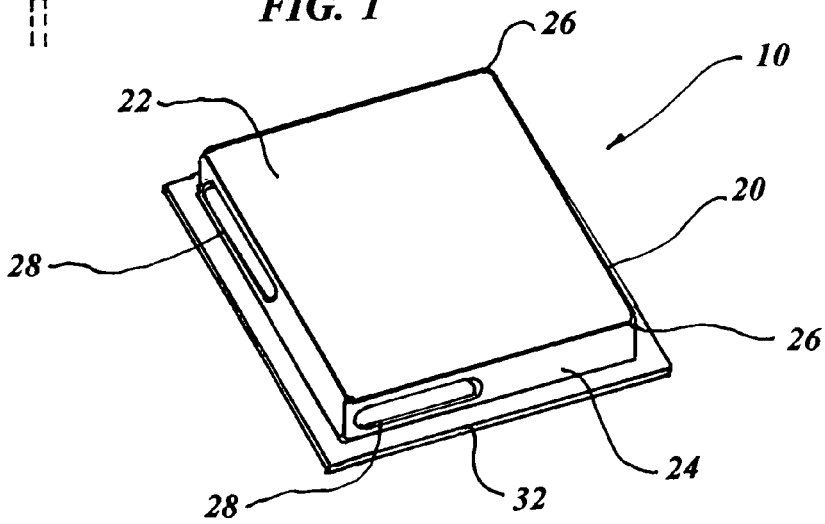
FIG. 2 is a partial isometric view of the ceiling air duct diverter in the preferred embodiment.

The best mode for carrying out the invention is presented in terms of a preferred, second and third embodiment. The preferred embodiment is illustrated in FIGS. 1-13 with the second embodiment pictorially depicted in FIGS. 14-20 and the third shown in FIGS. 21-26.

The preferred embodiment is comprised of a ceiling vent air diverter 10 having a diverter body 20 configured to attach underneath an existing air vent for a HVAC (heating, ventilating and air conditioning) system supplying air to a room of a residential or commercial building.

The diverter body 20 has a flat bottom 22 and upstanding sides 24, with the flat bottom 22 having a rectangular configuration with four right angular corners. The diverter body 20 is formed of a material such as acrylonitrile butadiene styrene (ABS), acrylic, celluloses, phenolic, polyethylene, polypropylene, polystyrene or polyvinyl chloride, with ABS preferred. The upstanding sides 24 are minimally tapered outward in a manner sufficient to permit vacuum forming, and have radiused corners 26. The outside surface of the body 20 is textured creating a pleasing appearance and permits paint to adhere if a different color than the primary white is desired. The body 20 preferably has a nominal thickness of 0.10 inches with variations from 0.080 to 0.120 inches.

The diverter body 20 may be almost any size with the actual dimensions derived from the following formula:

For use with a half panel T-bar ceiling installation

As an example square vent or register size nominal 24" by 24" (W by L)

Air Diverter OF=W+1.0" by L+1.0"

(OF=25" by 25")

Air Diverter IS=W−3" by L−3"

(IS=21" by 21")

As an example rectangular vent or register size nominal 14" by 6" (W by L)

Air Diverter OF=W+2.25" by L+2.25"

(OF=16.25" by 8.25")

Air Diverter IS=W−1.0" by L−1.0"

(IS=13" by 5")

Discharge Air Slot Size=0.5×W or L slot length=24"×0.5=12"

slot W=1.0" (constant)

(S=12" by 1.0")

Where:

OF=Over Flange Dimension

W=(nominal) width

L=(nominal) length

IS=inside diverter nominal dimension

S=slot size

Each upstanding side 24 incorporates a discharge air slot 28 permitting air to be distributed in opposed directions from the diverter 10. Each discharge air slot 28 preferably has radial slot ends 30 with the air slots 28 having a width of from 0.9 to 1.10 inch wide (1.0 inch nominal) and a length of essentially one half of the diverter 10 side width. The discharge air slots 28 are aligned in side opposition from each other such that each discharge air slot 28 is opposed laterally. The upstanding side 24 has a height of from 1.40 to 1.60 inches high with a nominal 1.50 inch preferred. A peripheral flange 32 extends outwardly from each side 24, in parallel relationship with the flat bottom 22 and is used for attachment to a building ceiling.

Figures 3, 4, 5, 6, 7, 8, 9, 10, 11, 12, 13:
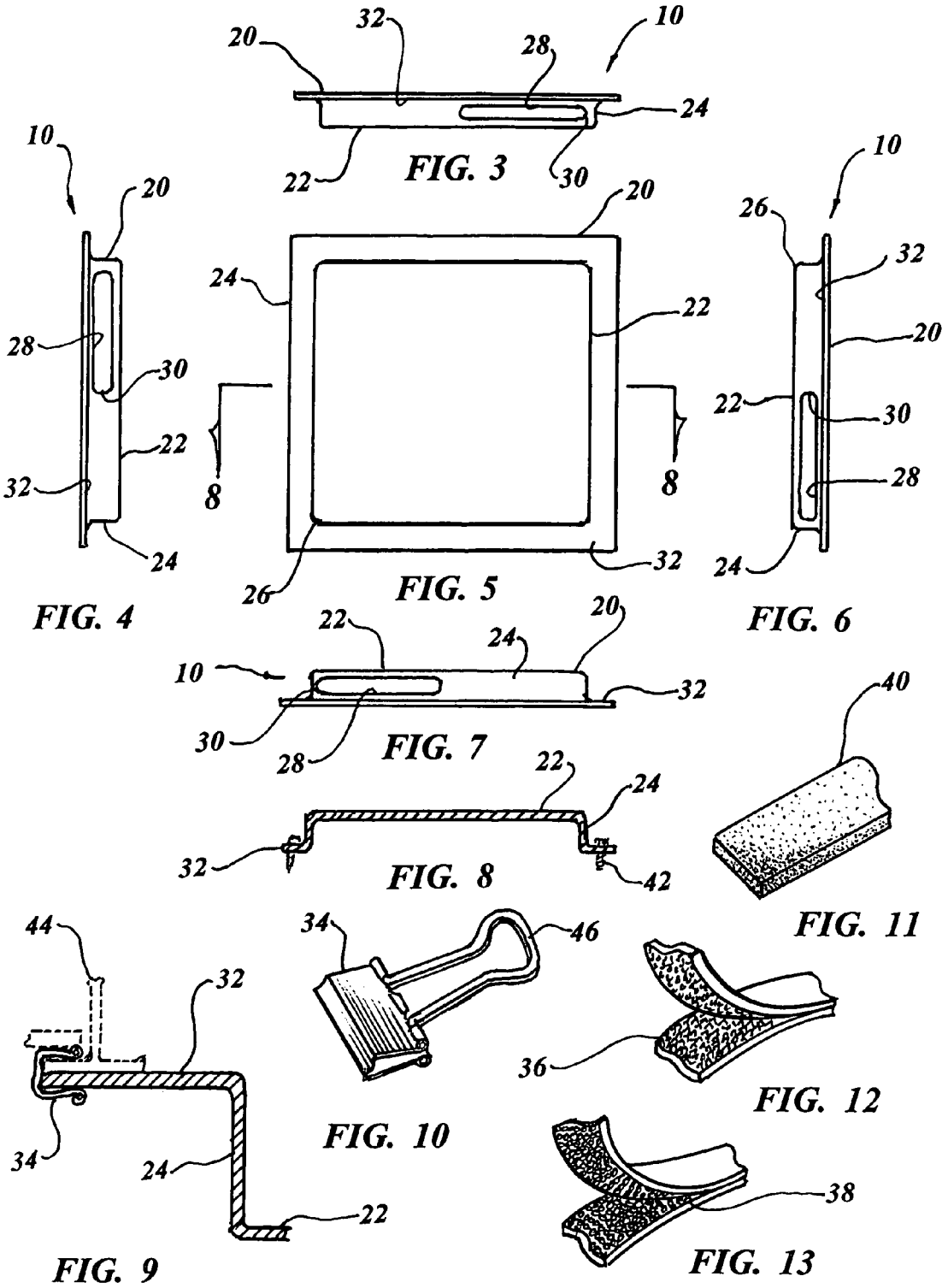
FIG. 3 is an upper side plan view of the diverter in the preferred embodiment.
FIG. 4 is a left side plan view of the diverter in the preferred embodiment.
FIG. 5 is a bottom plan view of the diverter in the preferred embodiment.
FIG. 6 is a right side plan view of the diverter in the preferred embodiment.
FIG. 7 is a lower side plan view of the diverter in the preferred embodiment.
FIG. 8 is a cross sectional view taken along lines 8-8 of FIG. 5 with attachment means illustrated.
FIG. 9 is a cross sectional view taken along an imaginary line of a T-bar supported ceiling illustrating the ceiling air duct diverter in the preferred embodiment and a metal binder clip with the wireform handles removed in the preferred means of affixing the flange of the air duct diverter to the T-bar ceiling.
FIG. 10 is a partial isometric view of one of the metal binder clips with its wireform handles attached, illustrated removed from the invention for clarity.
FIG. 11 is a partial isometric view of magnetic tape with pressure sensitive adhesive on one side, illustrated removed from the invention for clarity.
FIG. 12 is a partial isometric view of a segment of a fabric hook and loop fastener tape having pressure sensitive adhesive on both sides, illustrated removed from the invention for clarity.
FIG. 13 is a partial isometric view of a segment of a 3-M DUAL-LOCK® tape having pressure sensitive adhesive on both sides, illustrated removed from the invention for clarity.
Figure 14:
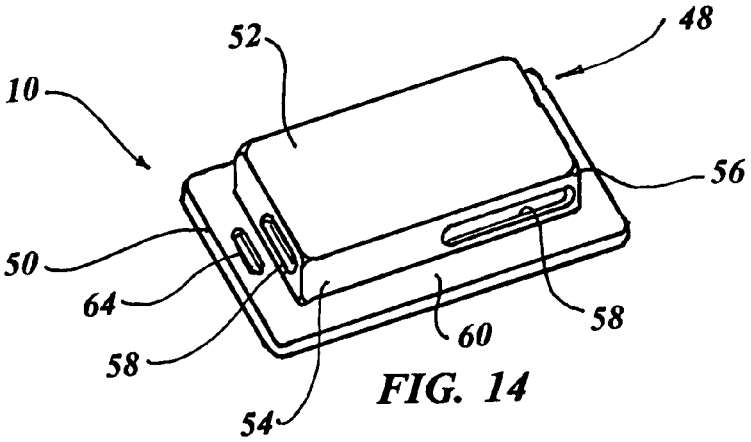
FIG. 14 is a partial isometric view of the air vent diverter in the second embodiment.
Figure 15:
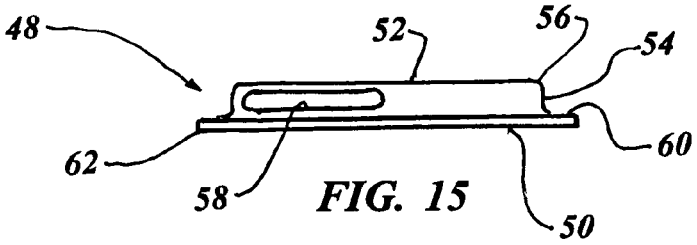
FIG. 15 is an upper side plan view of the diverter in the second embodiment.
Figure 16:
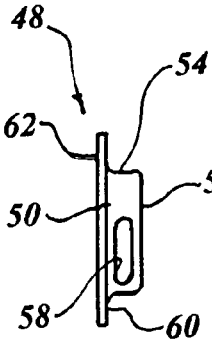
FIG. 16 is a left side plan view of the diverter in the second embodiment.
Figure 17:
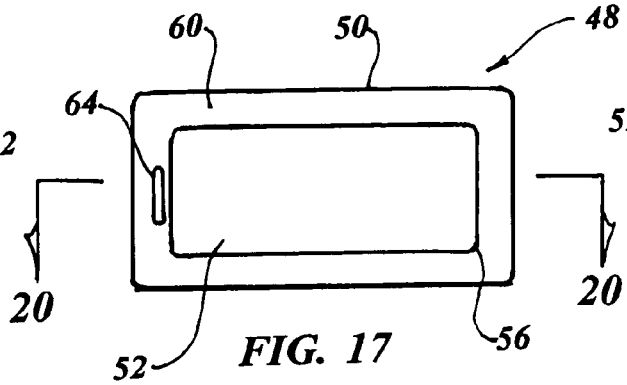
FIG. 17 is a bottom plan view of the diverter in the second embodiment.
Figure 18:
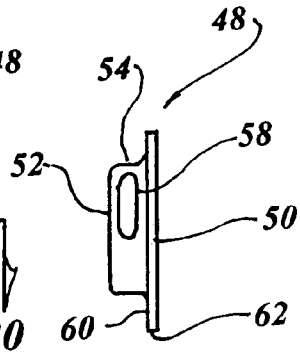
FIG. 18 is a right side plan view of the diverter in the second embodiment.
Figure 19:
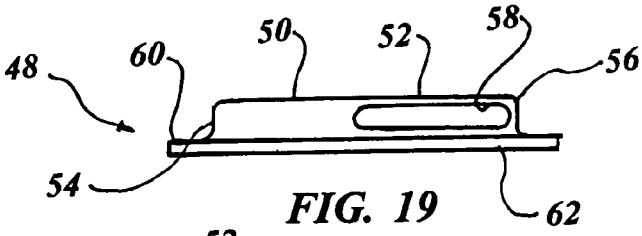
FIG. 19 is a lower side plan view of the diverter in the second embodiment.

Means for affixing the peripheral flange 32 of the diverter 10 to the ceiling may be defined as metal binder clips 34, illustrated in FIG. 10, fabric hook and loop fasteners 36, shown in FIG. 12, 3M Dual Lock® tapes, (heavy-duty reclosable fastening tapes) 38 depicted pictorially in FIG. 13, magnetic tapes 40, illustrated in FIG. 11, threaded fasteners 42 shown in FIG. 8 or any other method well known in the art.

FIGS. 9 and 10 illustrate the preferred metal binder clips 34 with FIG. 9 showing a single clip 34 attached to a T-bar ceiling 44. The clip 34 is preferably painted white and two clips 34 are attached on each flange 32 side for a total of eight clips 34 per diverter 10. The clips 34 include two wireform handles 46 which extend away from the open end allowing the clip 34 to spring open when manually compressed together permitting the clip 34 to be installed between the outer side of the flange 32 and the top side of the T-bar of the ceiling 44. The handles 46 are then removed by squeezing each side of the handle 46 together removing them from the curled ends of the clip 34, as illustrated in FIG. 9.

The second embodiment of the invention is for an air vent diverter 48, shown in FIGS. 14-20 and is configured to fit over the top of existing registers, grilles or air diffusers either on a ceiling or a wall of a residential or commercial building. The air vent diverter 48 consists of a diverter body 50 configured to envelop the exposed surface of an existing air vent for a HVAC (heating, ventilating and air conditioning) system.

The air vent diverter body 50 incorporates a flat outside surface 52 with inwardly facing sides 54 and the outside surface 52 has a rectangular configuration with four right angular radial corners 56. Each inwardly facing side 54 has an air discharge slot 58 permitting air to be distributed in opposed directions from the air vent diverter 48. Each discharge air slot 58 contains radial slot ends 30, the same as the preferred embodiment, with the air slots 58 having a width of from 0.9 to 1.10 inch wide (1.0" nominal) and a length of essentially one half of the diverter 48 side width. The air slots 58 may be aligned in opposition from each other such that each air slot 58 is laterally opposed.

The air vent diverter body 50 is formed of the same material and color as the preferred embodiment and incorporates the same textured outside surface. The diverter body 50 also has a thickness of from 0.080 to 0.120 inches with a nominal 0.100 inches preferred. Each inwardly facing side 54 has a height of from 1.40 to 1.60 inches high with a preference of nominally 1.50 inches.

Figure 20:
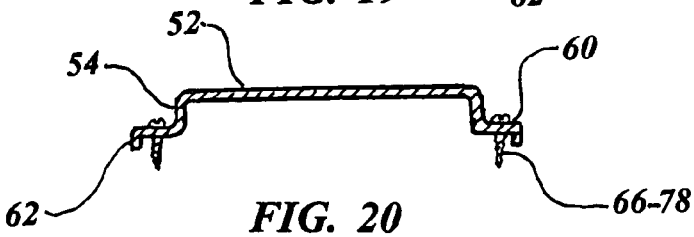
FIG. 20 is a cross sectional view taken along lines 20-20 of FIG. 17 with attachment means illustrated.
Figure 21:
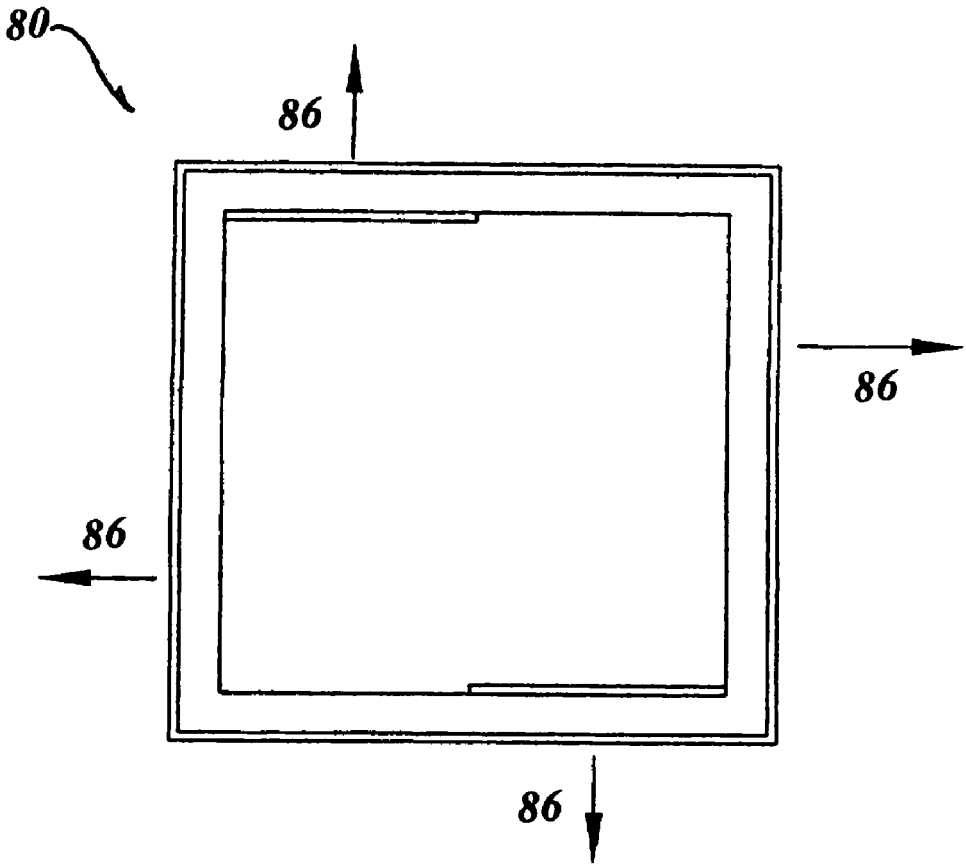
FIG. 21 is a plan view of the diverter system in the third embodiment.
Figure 22:
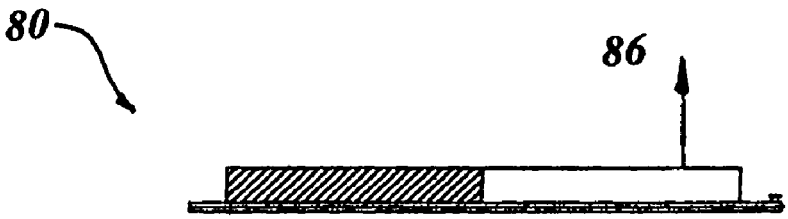
FIG. 22 is a side plan view of the diverter system in the third embodiment.
Figure 23:
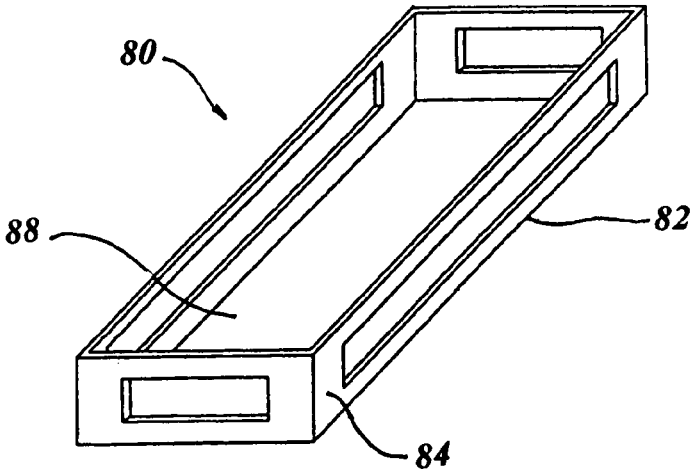
FIG. 23 is a partial isometric top view of the diverter in the third embodiment.
Figure 24:
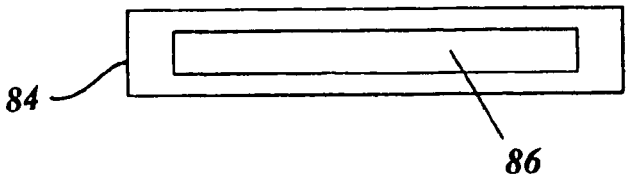
FIG. 24 is a long side plan view of the diverter in the third embodiment.
Figure 25:
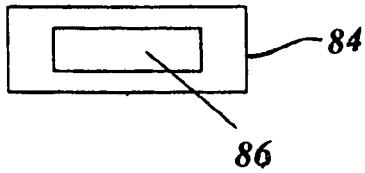
FIG. 25 is a short side plan view of the diverter in the third embodiment.
Figure 26:
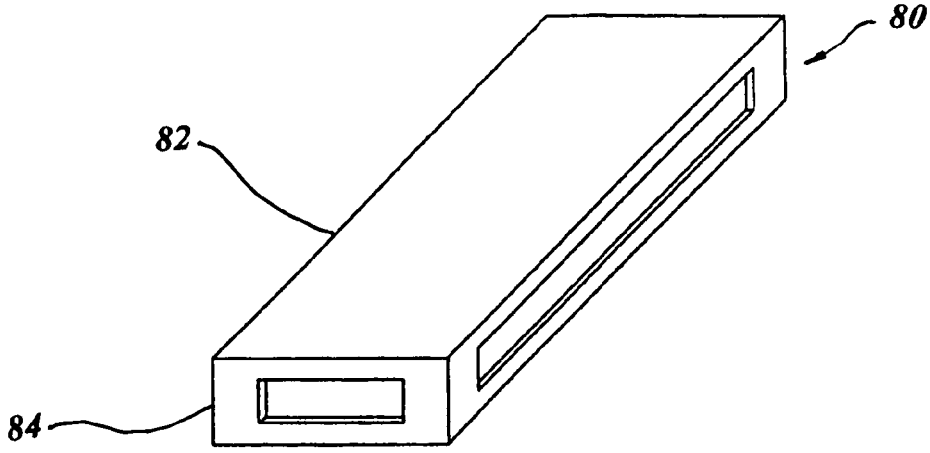
FIG. 26 is a partial isometric bottom view of the diverter in the third embodiment.

An integral flange 60 extends outwardly from each inwardly facing side 54, in parallel relationship with the flat outside surface 52 and a width from the outwardly facing sides of from 1.40 to 1.60 inches (1.5 inch nominal). The integral flange 60 has a peripheral lip 62 facing inward from the flange 60 in a direction parallel with the sides 54, as illustrated in FIG. 20. The peripheral lip preferably has a height of from 0.3 to 0.4 inches (0.38 inch nominal). The integral flange 60 may have a lever slot 64, depicted in FIGS. 14 and 17, configured to allow a vent actuating lever to extend therethrough for operation.

Means for affixing the integral flange 60 of the diverter 48 to a building may consist of sheet metal screws 66, self tapping screws 68, wood screws 70, toggle bolts 72, masonry anchors 74, hollow wall screw anchors 76 or self drilling wall board anchors 78, all of which are well known in the art and therefore are not illustrated individually but are shown collectively in FIG. 20.

The third embodiment, illustrated in FIGS. 21-26, discloses a ceiling air duct diverter system 80 comprising a box like housing 82 with side walls 84 having side openings 86 and an open top 88 with the side openings for diverting air flow. An attachment mechanism affixes the open top 88 near a ceiling air vent and consists of fabric hook and loop fasteners, magnets or screws, not illustrated.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

ELEMENT DESIGNATION 10 ceiling air diverter
20 diverter body
22 flat bottom (of 20)
24 upstanding sides (of 20)
26 radiused corners (of 20)
28 discharge air slot (in 24)
30 radial slot ends
32 peripheral flanges
34 metal binder clip
36 hook and loop fastener
38 3M Dual Lock® tape
40 magnetic tape
42 threaded fasteners
44 T-bar ceiling
46 wireform handles
48 air vent diverter
50 air vent diverter body
52 flat outside surface (of 50)
54 inwardly facing sides
56 right angular radial corners (of 54)
58 air discharge slots (in 54)
60 integral flange (from 54)
62 peripheral lip (on 60)
64 lever slot (in 60)
66 sheet metal screws
68 self tapping screws
70 wood screws
72 toggle bolts
74 masonry anchors
76 wall screw anchors
78 wall board anchors
80 ceiling air duct diverter system
82 box like housing
84 side walls
86 side openings (in 84)
88 open top

The invention claimed is:

1. A ceiling vent air diverter comprising, a diverter body configured to cover beneath an existing air vent for a HVAC (heating, ventilating and air conditioning) system supplying air to a room of a residential or commercial building, said diverter body having a flat bottom and upstanding sides, with the flat bottom having a rectangular configuration and four right angular rounded corners and an internal space free of obstructions, each upstanding side having only one discharge air slot diagonally opposed from each other permitting air to be distributed in four separate directions from the diverter, a peripheral flange extending outwardly from each side, in parallel relationship with said bottom and is used for attachment to a ceiling of the building, and a plurality of metal clips attached onto the peripheral flange of the diverter and to a ceiling member of the building such that the plurality of metal clips holds the peripheral flange up against a bottom surface of the ceiling member.

2. The ceiling vent air diverter as recited in claim 1 wherein said diverter body is formed of a material selected from the group consisting of acrylonitrile butadiene styrene (ABS), acrylic, celluloses, phenolic, polyethylene, polypropylene, polystyrene and polyvinyl chloride.

3. The ceiling vent air diverter as recited in claim 1 wherein said diverter body further comprises a outside surface that is an uneven surface that is not smooth.

4. The ceiling vent air diverter as recited in claim 1 wherein said diverter body further comprises a thickness of from 0.080 to 0.120 inches and said body having a primary white color.

5. The ceiling vent air diverter as recited in claim 1 wherein each upstanding side discharge air slot further having radial slot ends with said air slots having a width of from 0.9 to 1.10 inch wide and a length of essentially one half of the diverter side width, wherein said air slots are aligned in side opposition from each other such that each air slot is laterally opposed.

6. The ceiling vent air diverter as recited in claim 1 wherein said upstanding side further comprises a height of from 1.40 to 1.60 inches high.

7. The ceiling vent air diverter as recited in claim 1 wherein said peripheral flange has a width from the upstanding sides of from 1.90 to 2.10 inches.

8. An air vent diverter comprising, a diverter body formed of acrylonitrile butadiene styrene (ABS) and configured to cover an existing air vent for a HVAC (heating, ventilating and air conditioning) system supplying air to a room of a residential or commercial building, said diverter body having a flat outside surface with upstanding sides and the outside surface having a rectangular configuration with four right angular rounded corners and an internal space free of obstructions, each upstanding side having a only one discharge air slot diagonally opposed from each other permitting air to be distributed in four separate directions from the diverter, an integral flange extending outwardly from each upstanding side, in parallel relationship with said flat outside surface, and a plurality of metal clips affixed to the integral flange of the diverter and a ceiling portion of the building such that the plurality of metal clips holds the integral flange up against a bottom surface of the ceiling portion.

9. The air vent diverter as recited in claim 8 wherein said diverter body further comprises a thickness of from 0.080 to 0.120 inches and said body having a primary white color.

10. The air vent diverter as recited in claim 8 wherein each upstanding side further comprises a height of from 1.40 to 1.60 inches high.

11. The air vent diverter as recited in claim 8 wherein said integral flange having a lever slot configured to allow a vent actuating lever to extend therethrough.

12. The air vent diverter as recited in claim 8 wherein each discharge air slot further having radial slot ends with said air slots having a width of from 0.9 to 1.10 inch wide and a length of essentially one half of the diverter side width.

13. The air vent diverter as recited in claim 8 wherein said integral flange has a width from the inwardly facing sides of from 1.40 to 1.60 inches.

14. An air vent diverter consisting of, a diverter body formed of acrylonitrile butadiene styrene (ABS) and configured to cover an existing air vent for a HVAC (heating, ventilating and air conditioning) system supplying air to a room of a residential or commercial building, said diverter body having a flat outside surface with upstanding sides and the outside surface having a rectangular configuration with four right angular rounded corners and an internal space free of obstructions, each upstanding side having only one discharge air slot opposed from each other permitting air to be distributed in four separate directions from the diverter, an integral flange extending outwardly from each side, said flange having a peripheral lip configured to envelop an exposed surface of the existing air vent for a HVAC (heating, ventilating and air conditioning) system, and a plurality of fasteners affixed to the integral flange of the diverter and a ceiling portion of the building.

15. The air vent diverter as recited in claim 14 wherein said peripheral lip having a height of from 0.3 to 0.4 inches.

* * * * *